US008028831B2

(12) United States Patent
Kakuta et al.

(10) Patent No.: US 8,028,831 B2
(45) Date of Patent: Oct. 4, 2011

(54) PACKAGE STRUCTURE FOR DISPLAY DEVICE

(75) Inventors: Yoshinori Kakuta, Tokyo (JP); Shigeru Takeuchi, Tokyo (JP); Hirokazu Taguchi, Tokyo (JP); Naoki Kanno, Tokyo (JP); Kimito Nishikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 112 days.

(21) Appl. No.: 12/149,905

(22) Filed: May 9, 2008

(65) Prior Publication Data

US 2009/0065385 A1 Mar. 12, 2009

(30) Foreign Application Priority Data

Sep. 12, 2007 (JP) ..... 2007-236109

(51) Int. Cl.
*B65D 85/00* (2006.01)

(52) U.S. Cl. ..... 206/320; 206/585; 206/586; 206/521

(58) Field of Classification Search ..... 206/320, 206/316.1, 521, 523, 585, 586, 588, 590, 206/591, 592, 594, 326, 335
See application file for complete search history.

(56) References Cited

U.S. PATENT DOCUMENTS

| | | | | |
|---|---|---|---|---|
| 5,398,808 | A * | 3/1995 | Chen et al. | 206/320 |
| 5,445,266 | A * | 8/1995 | Prete et al. | 206/320 |
| 5,715,940 | A * | 2/1998 | Son | 206/320 |
| 6,257,407 | B1 * | 7/2001 | Truwit et al. | 206/320 |
| 6,967,836 | B2 * | 11/2005 | Huang et al. | 361/679.46 |
| 2003/0127353 | A1 * | 7/2003 | Kropf et al. | 206/523 |
| 2003/0209464 | A1 * | 11/2003 | Otsuka et al. | 206/586 |
| 2006/0113214 | A1 * | 6/2006 | Shimizu et al. | 206/576 |
| 2006/0219596 | A1 * | 10/2006 | Lin et al. | 206/592 |
| 2006/0243638 | A1 * | 11/2006 | Sato | 206/736 |
| 2007/0095703 | A1 * | 5/2007 | Kao et al. | 206/454 |
| 2007/0131574 | A1 * | 6/2007 | Aoki | 206/454 |
| 2007/0145212 | A1 * | 6/2007 | Yamanaka | 248/176.1 |
| 2007/0215501 | A1 * | 9/2007 | Hanson et al. | 206/320 |
| 2008/0000803 | A1 * | 1/2008 | Tseng et al. | 206/591 |
| 2008/0112115 | A1 * | 5/2008 | Yang | 361/681 |
| 2009/0032421 | A1 * | 2/2009 | Sween et al. | 206/320 |
| 2010/0096285 | A1 * | 4/2010 | Kinuhata | 206/320 |

FOREIGN PATENT DOCUMENTS

JP 2007-017737 A 1/2007

* cited by examiner

*Primary Examiner* — David Fidei

(74) *Attorney, Agent, or Firm* — Birch, Stewart, Kolasch & Birch, LLP

(57) ABSTRACT

A package structure prevents an optical sheet from being brought into contact with a display panel and making scratches on the display panel due to motion caused during transport of a display device, thereby minimizing cost increase. A package structure for a thin display device is the structure for storing the thin display device in a package case. The thin display device includes at least one optical sheet situated in approximately parallel with its display surface, and the package case includes a storage member for holding a thin display device with the optical sheet having a surface inclined relative to a vertical direction.

3 Claims, 5 Drawing Sheets

PACKAGE STRUCTURE FOR DISPLAY DEVICE

BACKGROUND OF THE INVENTION

1. Field of the Invention

The invention relates to a package structure for a display device with an optical sheet.

2. Description of the Background Art

Conventional liquid crystal displays are configured for example as shown in FIG. 2 of Japanese Patent Application Laid-open No. 2007-17737. That is, a display panel 1 is held vertically by a first frame member 403 and a second frame member 402 mounted inside the first frame member 403. A diffuser plate 301 and an optical sheet 302 are mounted at an angle so as to allow a wide space between themselves and the upper part of the display panel 1 with respect to the direction of their weight, with their upper ends held between a first spacer 404 and a third frame member 401 and their lower ends held between a second spacer 405 and the second frame member 402.

Backlights 2 mounted behind the diffuser plate 301 have different pitches from one another according to their corresponding intervals between the display panel 1 and the diffuser plate 301 so that illumination emitted from the backlights 2 can provide uniform brightness after its passing through the diffuser plate 301, the optical sheet 302, and the display panel 1. In order to avoid deformation of the diffuser plate 301 due to a change of temperature and/or humidity, a structure as shown in FIG. 5 of Japanese Patent Application Laid-open No. 2007-17737 is used, in which a plurality of supports 8 of different dimensions are buried in the third frame member 401 with their tips abutting the diffuser plate 301 so as to support the diffuser plate 301.

As described above, mounting the diffuser plate 301 and the optical sheet 302 at an angle to the display panel 1 in a thin display device prevents the optical sheet 302 or the like that has especially low rigidity from being brought into contact with the display panel 1 and making scratches on the display panel 1 due to motion caused during transport or the like.

However, the structure described above still has the problem of cost increase due to increased design time and an increased number of parts, because the backlights 2 must be arranged at different pitches and parts of different dimensions are necessary for the supports 8 arranged from top to bottom.

SUMMARY OF THE INVENTION

An object of the invention is to provide a package structure for a display device, which structure minimizes cost increase due to increased design time and an increased number of parts and prevents an optical sheet from being brought into contact with the display panel and making scratches on the display panel due to motion caused during transport of the display device.

A package structure for a display device according to the invention is the structure for storing a display device in a package case. The display device includes at least one optical sheet situated in approximately parallel with its display surface. The package case includes a storage member for holding the display device with the optical sheet having a surface inclined relative to a vertical direction.

Since the optical sheet is held at an angle to the bottom face of the package case, the amplitude of horizontal motion of the optical sheet excited by vertical motion during transport can be reduced by a component of the force of its own weight. This prevents scratches caused by contact of the optical sheet and the display panel or scratches made between a plurality of optical sheets. Since the optical sheet is situated in approximately parallel with the display panel, and in general, the diffuser plate is situated in parallel with the optical sheet, backlights can be provided at regular pitches. This allows the use of parts of the same size for all the supports that support the diffuser plate, thereby minimizing cost increase.

These and other objects, features, aspects and advantages of the present invention will become more apparent from the following detailed description of the present invention when taken in conjunction with the accompanying drawings.

DESCRIPTION OF THE PREFERRED EMBODIMENTS

Now, a preferred embodiment of the invention is concretely described with reference to the drawings.

Figure 1:
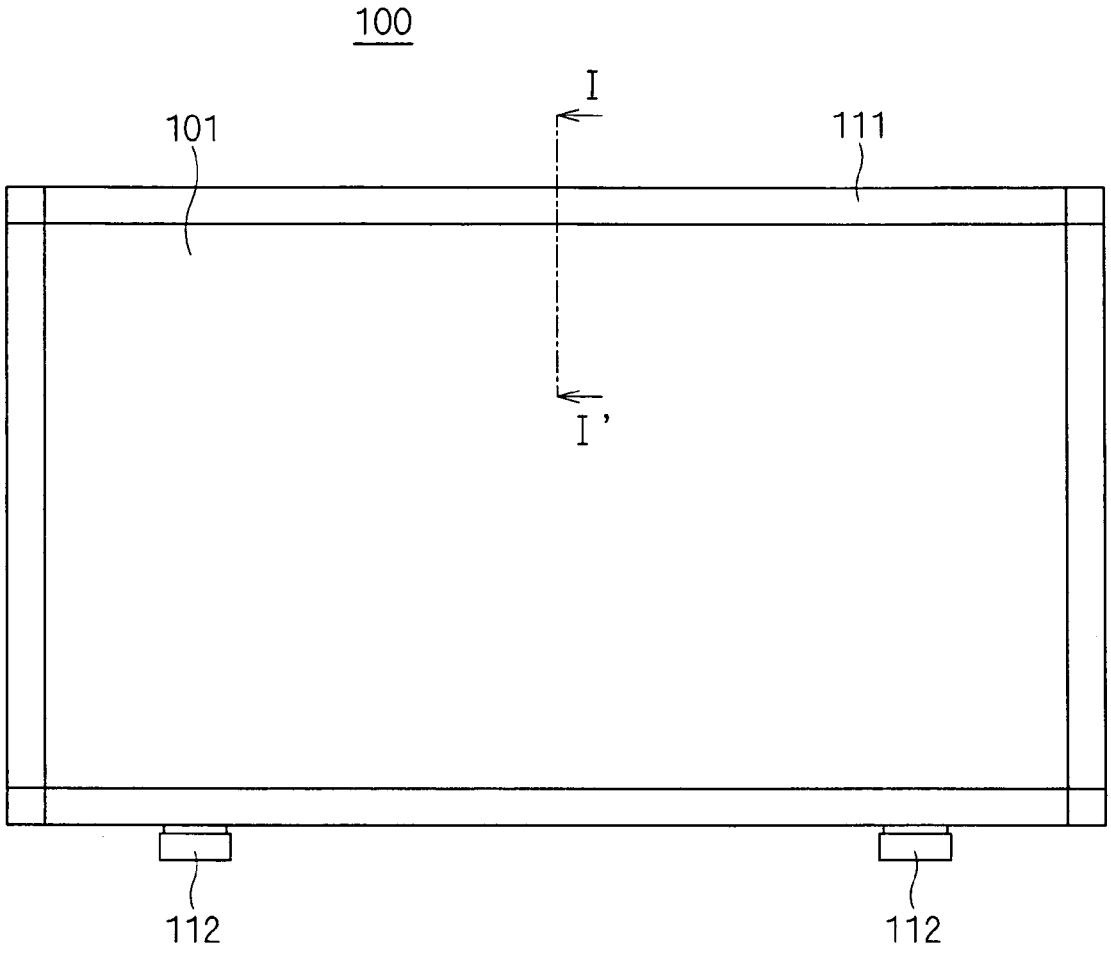
FIG. 1 is a front view of a thin display device according to the invention.
Figure 2:
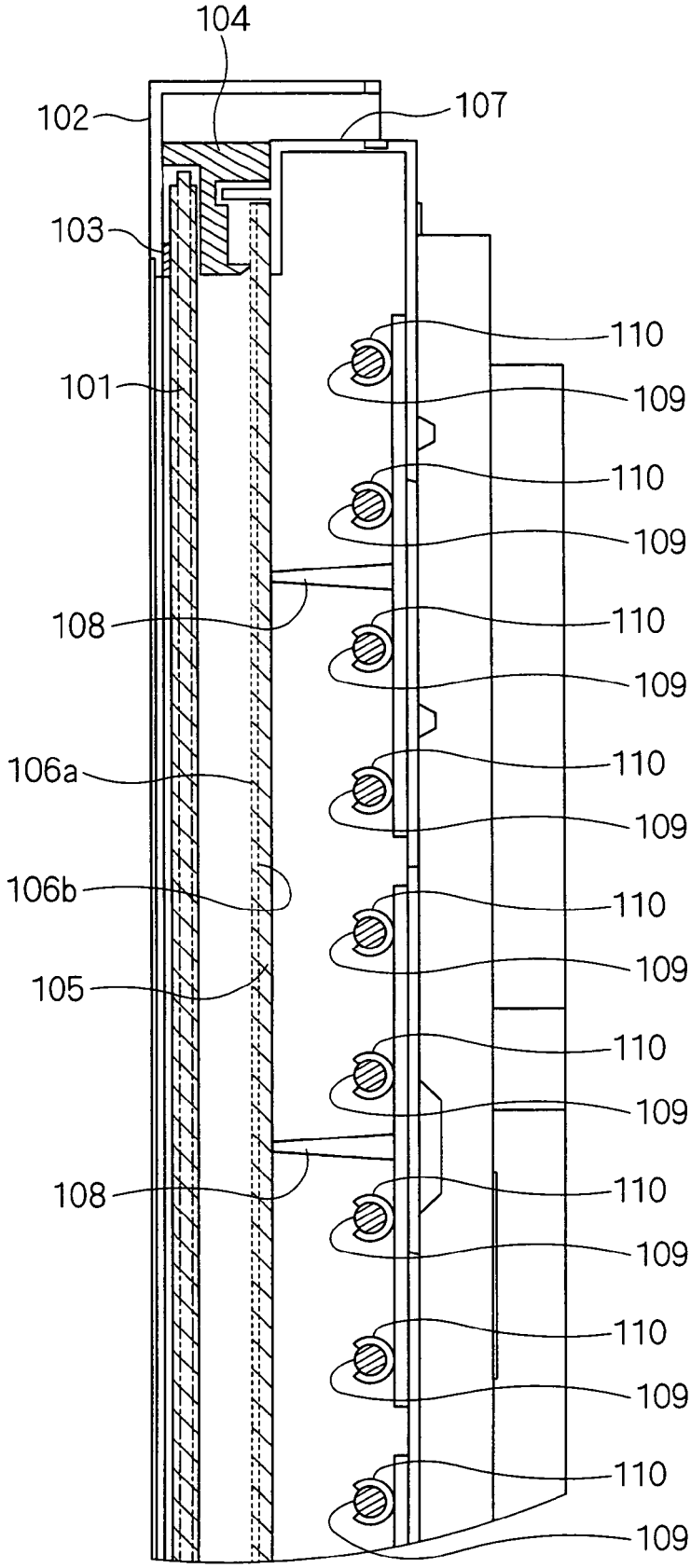
FIG. 2 is a cross-sectional view showing the essential parts of the display device according to the invention.

FIG. 1 is a front view of a thin display device 100 of a first preferred embodiment of the invention, and FIG. 2 is a cross-sectional view showing the essential parts taken by line I-I' in FIG. 1. As shown in FIG. 2, a display panel 101 has its outer rim held between a cushion 103 and a spacer 104 that are fixed inside a first frame 102; optical sheets 106*a* and 106*b* and a diffuser plate 105 that diffuses illumination emitted from backlights 109 have their outer rims held between a second frame 107 and the spacer 104; and the display panel 101, the diffuser plate 105, and the optical sheets 106*a* and 106*b* are situated in approximately parallel with a display surface.

The second frame 107 have a plurality of supports 108 of the same size formed thereon at regular intervals. On the bottom of each of the supports 108, four retaining members 110 of the same size that hold the backlights (light sources) 109 are formed in parallel with the optical sheets 106*a* and 106*b* and at regular intervals. All the plurality of supports 108 have their tips abutting the back side of the diffuser plate 105 to support the diffuser plate 105. The plurality of backlights 109 held by the retaining members 110 formed at regular intervals as described above are arranged at regular intervals in a vertical direction behind the back side of the optical sheets 106*a* and 106*b*.

The supports 108 are manufactured by injection molding using a resin mold and thus are relatively inexpensive, and only one mold is necessary even in the case of using a number of parts of the same shape. Since the display panel 101, the diffuser plate 105, and the optical sheets 106*a* and 106*b* are situated in parallel with one another, even if the backlights 109 are provided at regular intervals, illumination emitted from the backlights 109 is transmitted through and diffused by the diffuser plate 105. Thus, the display panel 101 can be irradiated with uniform brightness of light.

The first frame 102 and the second frame 107 are stored and fixed in a casing 111 shown in FIG. 1. The front and back sides of the casing 111 are in parallel with the display panel 101.

Further, two stands (legs) 112 extending back and forth at approximately a right angle to the planes of the optical sheets 106*a* and 106*b* are fixed on the ground of the casing 111.

Figure 3:
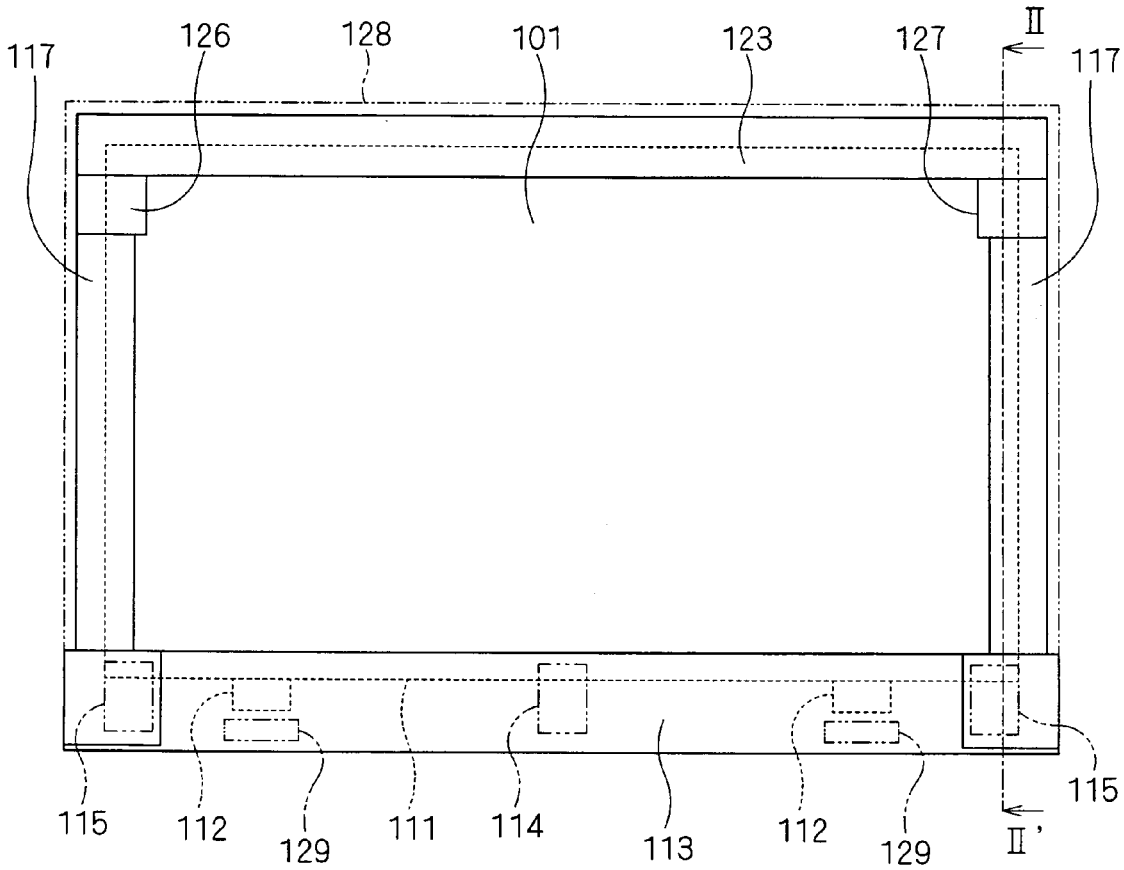
FIG. 3 is a front view of a packaged display device according to the invention.
Figure 4:
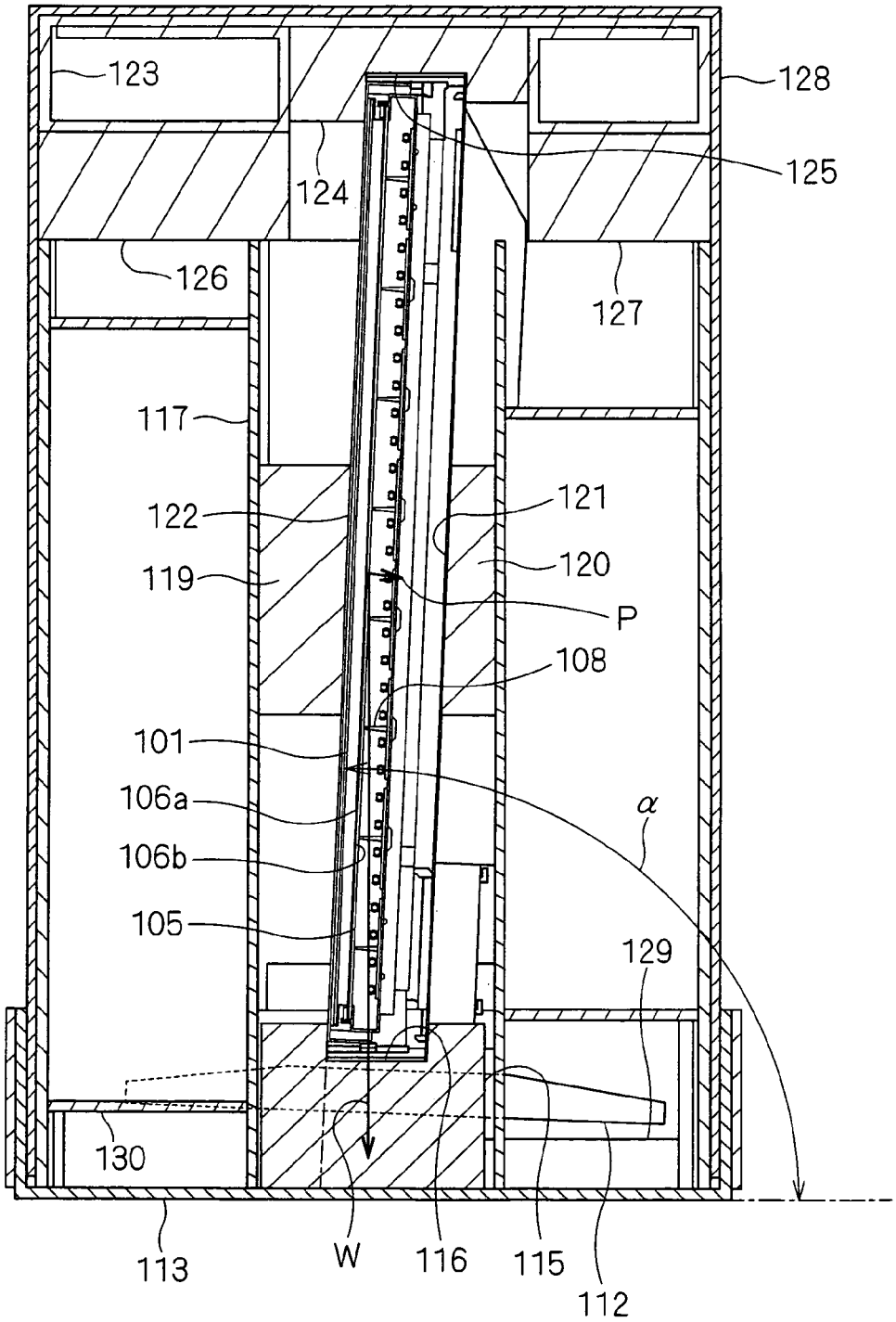
FIG. 4 is a cross-sectional view showing the essential parts of the packaged display device according to the invention.
Figure 5:
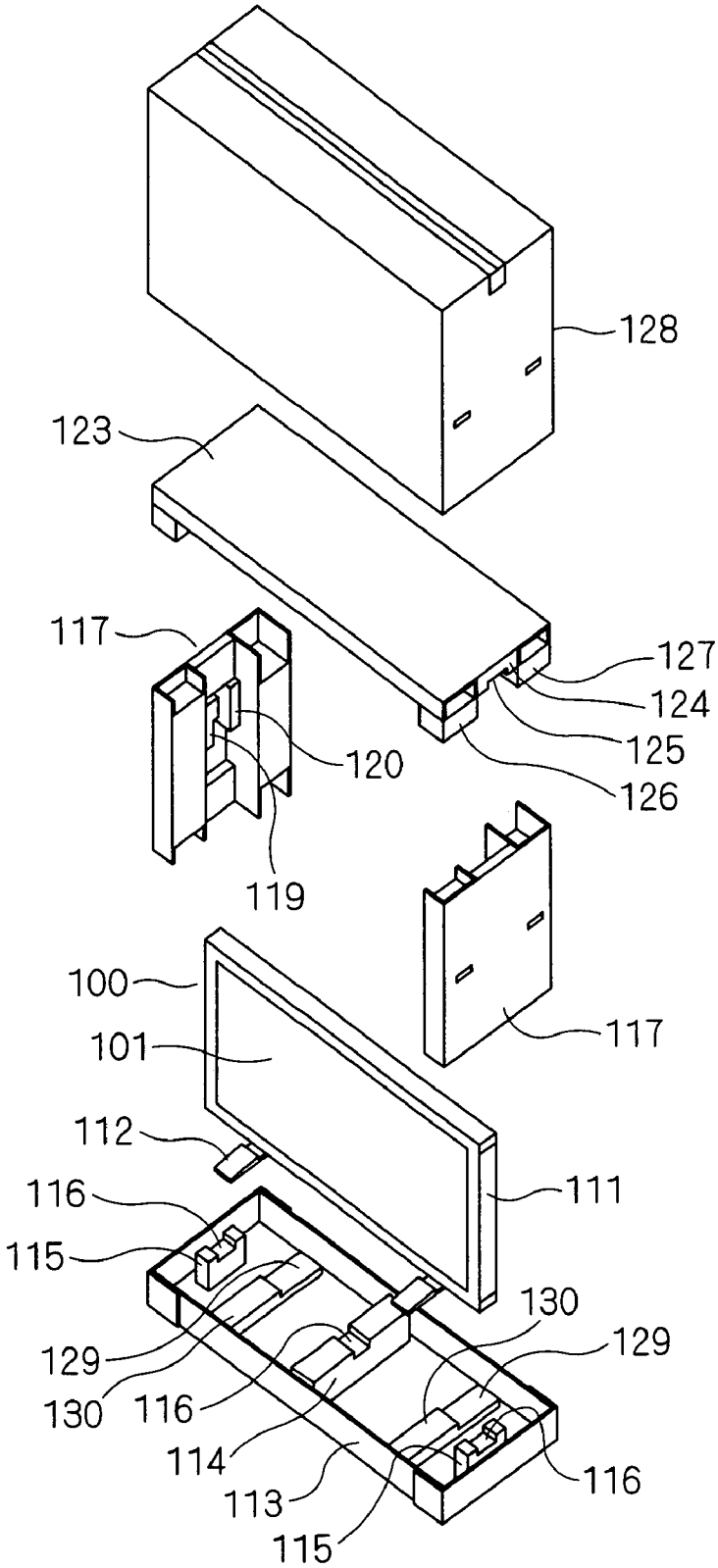
FIG. 5 is an exploded perspective view of the packaged display device according to the invention.

Next described is a package structure for the thin display device 100 in which the thin display device 100 is stored in a package case. FIG. 3 is a front view of the packaged thin display device 100; FIG. 4 is a cross-sectional view taken by line II-II' of FIG. 3; and FIG. 5 is an exploded perspective view of the whole structure. The package case includes a lower case 113, an upper case 128, and a storage member for holding the thin display device 100 therein at an angle to a vertical direction.

A buffer member 114 of styrene foam or the like is provided in the middle of the lower case 113 of the package case, and buffer members 115 are provided at both sides of the package case. The buffer members 114 and 115 each have a depression 116 formed in their upper surfaces, which depression abuts the underside of the casing 111 and holds parts of the front and back sides of the casing 111. Further, side plates 117 formed by bending a corrugated fiberboard are provided on both sides of the casing 111. The side plates 117 each have fixed thereto buffer members 119 and 120 of styrene foam or the like that hold the sides of the casing 111 therebetween.

The buffer members 119 and 120 have inclined surfaces 121 and 122, respectively, so that the casing 111 is inclined along the inclined surfaces 121 and 122. The direction of inclination is such a direction that the angle $\alpha$ formed by the display panel 101 and the bottom of the lower case 113 is less than 90 degrees.

The lower case 113 have an installation member 130 formed thereon between the buffer member 114 in the middle and the buffer member 115 on each side. The installation members 130 abut the undersides of the fore parts of the stands 112. In the rear of the installation members 130, anti-falling members 129 are formed with a step to prevent the thin display device 100 from falling down at the time of opening of the package case.

A top plate 123 is provided on the side plates 117. The top plate 123 has a buffer member 124 fixed thereto to hold the upper part of the casing 111 and has depressions 125 formed therein, which depressions 125 are opposite the depressions 116 formed in the buffer members 114 and 115, to hold the casing 111 in an inclined position with respect to a direction perpendicular to the lower case 113.

The top plate 123 also has buffer members 126 and 127 fixed thereto and abutting the side plates 117. After the thin display device 100 is covered over with the upper case 128 and when the lower case 113 and the upper case 128 are tightened with a band not shown, the buffer members 126 and 127 are somewhat compressed, by which the side plates 117 are pressed downwardly. This prevents looseness of the side plates 117.

Now the condition of the thin display device 100 during packaging is discussed anew. The casing 111 of the thin display device 100 is held by the buffer members 119 and 120 while abutting the depressions 116 and 125 formed in the buffer members 114, 115, and 124, and the undersides of the fore parts of the stands 112 are on the installation members 130. At this time, the anti-falling members 129 are spaced from the undersides of the back parts of the stands 112, so that the stands 112 do not abut the anti-falling members 129. Stored by those storage members, the thin display device 100 is held in an inclined position.

<Operation>

Next, the operation of the packaged thin display device 100 at the occurrence of motion is described.

With the thin display device 100 in the aforementioned position, when the diffuser plate 105 is excited by the effect of transport motion, a horizontal component P of the weight W of the diffuser plate 105 causes a slight increase in the abutment pressure of the diffuser plate 105 against the supports 108 as compared with that in the case where the diffuser plate 105 is held in a vertical position. However, even if transport motion makes scratches on the surface of contact between the diffuser plate 105 and the supports 108, that surface is only the plane of incidence of illumination emitted from the backlights 109 so that shadows caused by scratches can be diffused on the way to the plane of emergence, which is the back side of the plane of incidence, and do not affect image quality of the display panel 101.

Besides, since the horizontal component P of the weight W of the diffuser plate 105 is opposite in direction to a component of the exciting force that is caused by transport motion and that tries to move the diffuser plate 105 in the direction of the display panel 101, the amplitude of motion of the diffuser plate 105 in the direction of the display panel 101 can be reduced. In other words, the horizontal component P of the weight W of the diffuser plate 105 is added to the force in the direction to pull the diffuser plate 105 to the opposite side of the display panel 101, which is equivalent to the condition that the motion of the diffuser plate 105 is prevented as if the diffuser plate 105 is lightly pulled backward with a string.

The optical sheets 106*a* and 106*b* that are thin and possess low stiffness make forward and backward motion with motion of the diffuser plate 105. The amounts of forward and backward motion of the optical sheets 106*a* and 106*b* decrease with decreasing amount of forward and backward motion of the diffuser plate 105, and they also decrease with the horizontal component of the force of their weight.

Next, the operation of the thin display device 100 at the time of package opening is described. The procedure for opening the package is such that the upper case 128, the top plate 123, and the side plates 117 are removed in this order. At this time, since the thin display device 100 is packaged in advance in an inclined position as described above and the stands 112 have only the undersides of their fore parts abutting the lower case 113, the thin display device 100 leans backward under a component of the force of its own weight during package opening. However, the lean of a somewhat angle of the thin display device 100 causes the rear ends of the stands 112 to abut the anti-falling members 129, so that the thin display device 100 comes to a standstill without falling down backward during package opening.

<Advantageous Effects>

The effect of the invention is as follows. Since a plurality of optical sheets adjacent to each other are held at an angle, the amount of horizontal motion of the optical sheets 106*a* and 106*b* excited by the effect of transport motion can be reduced by the horizontal component of the force of their weight. This prevents the optical sheets 106*a* and 106*b* from rubbing against each other and making scratches thereon, and also prevents the optical sheet 106*a* from being brought into contact with the display panel 101 and making scratches on the display panel 101.

Since the diffuser plate 105 is also inclined from its vertical position in a direction of its abutment against the supports 108, the amount of horizontal motion of the diffuser plate 105 excited by the effect of transport motion can be reduced by the horizontal component of the force of its own weight, and the amount of forward and backward motion of the optical sheets 106*a* and 106*b* can be reduced correspondingly. This prevents scratches caused by contact of the display panel 101 and the optical sheet 106*a*. Further, since the diffuser plate 105 and the display panel 101 are situated in parallel with each other, the supports 108 from top to bottom and the retaining members 110 of the backlights 109 from top to bottom, each can be made of the same parts. This allows the joint use of parts and thereby results in cost reduction.

On the bottom of the package case, the anti-falling members 129 are provided with a slight space from the undersides of the back parts of the stands 112 in the thin display device 100. This prevents the device itself from falling down at the time of package opening.

Application examples of the invention include the application to displays such as a large-screen liquid crystal display. The invention is also applicable to flat displays using plasma or organic EL technology, and to projection displays including a screen of optical sheets and a projection display unit.

While the invention has been shown and described in detail, the foregoing description is in all aspects illustrative and not restrictive. It is therefore understood that numerous modifications and variations can be devised without departing from the scope of the invention.

What is claimed is:

1. A package structure configured to store a display device in a package case, said display device including at least one optical sheet situated in approximately parallel with a display surface, and said package case including a storage member, said storage member having a lower case and an upper case which form an enclosure around said storage member and that holds said display device with said optical sheet having a surface inclined relative to a vertical direction of said storage member said storage member including a top plate, a first side plate and a second side plate, said first and second side plates including buffers which abut the display device on two sides and holds the display device at an angle less than 90 degrees relative to the lower case, the top plate abutting the first and second side plates at one end.

2. A package structure configured to store a display device in a package case, said display device including at least one optical sheet situated in approximately parallel with a display surface, and said package case including a storage member that holds said display device with said optical sheet having a surface inclined relative to a vertical direction, wherein said display device has, on a ground side, a leg extending back and forth at approximately a right angle to the surface of said optical sheet, and said storage member includes:

an installation member abutting an underside of a fore or back part of said leg; and an anti-falling member spaced from the underside of a non-abutting part of said leg and preventing said display device from falling down at a time of opening of said package case.

3. The package structure according to claim 1, wherein said display device further includes:

a plurality of light sources situated in parallel with said optical sheet and at regular intervals behind a back side of said optical sheet;

a plurality of retaining members of a same size that hold said plurality of light sources;

a diffuser plate situated in parallel with said optical sheet and diffusing illumination emitted from said plurality of light sources; and a plurality of supports of a same size that abut and support said diffuser plate.

* * * * *